US011807431B2

(12) United States Patent
Cotte et al.

(10) Patent No.: US 11,807,431 B2
(45) Date of Patent: Nov. 7, 2023

(54) PACKAGING ITEM COMPRISING MEANS FOR RETAINING AN OBJECT

(71) Applicant: PA. COTTE SA, Pully (CH)

(72) Inventors: Pierre-Alain Cotte, Amberg (DE); Damien Limousin, Saint Etienne de Montluc (FR); Denis Mourrain, Vertou (FR); Charles Colas, Nantes (FR); Ronan Affre De Saint Rome, Oudon (FR)

(73) Assignee: PA. COTTE SA, Pully (CH)

( * ) Notice: Subject to any disclaimer, the term of this patent is extended or adjusted under 35 U.S.C. 154(b) by 0 days.

(21) Appl. No.: 18/032,483

(22) PCT Filed: Oct. 15, 2021

(86) PCT No.: PCT/EP2021/078710
§ 371 (c)(1),
(2) Date: Apr. 18, 2023

(87) PCT Pub. No.: WO2022/084203
PCT Pub. Date: Apr. 28, 2022

(65) Prior Publication Data

US 2023/0286693 A1 Sep. 14, 2023

(30) Foreign Application Priority Data

Oct. 19, 2020 (FR) ..... 2010712

(51) Int. Cl.
*B65D 81/02* (2006.01)
*B65D 5/50* (2006.01)

(52) U.S. Cl.
CPC ..... *B65D 5/5028* (2013.01); *B65D 2581/051* (2013.01)

(58) Field of Classification Search
CPC .... B65D 5/5028; B65D 5/241; B65D 25/102; B65D 81/07; B65D 2581/051
(Continued)

(56) References Cited

U.S. PATENT DOCUMENTS 6,302,274 B1 * 10/2001 Ridgeway ..... B65D 5/5038 206/583
9,309,024 B2 4/2016 Hammerschmidt
(Continued)

FOREIGN PATENT DOCUMENTS

KR 101370760 3/2014
WO 2020/104339 5/2020

OTHER PUBLICATIONS

International Search Report and Written Opinion as issued by the International Searching Authority, dated Dec. 21, 2021, for International Patent Application No. PCT/EP2021/078710; 14 pages.
(Continued)

*Primary Examiner* — Luan K Bui
(74) *Attorney, Agent, or Firm* — Faegre Drinker Biddle & Reath LLP

(57) ABSTRACT

The invention relates to a package comprising a crate having a bottom, the package further comprising retaining means comprising an elastically deformable skin for holding at least one object (O) against the bottom of the crate, characterized in that the elastically deformable skin has a central elastic area and a peripheral elastic area around the central elastic area, the central elastic area having a lower elasticity than the peripheral elastic area, and in that the elastically deformable skin also comprises at least one elastic tertiary area extending the central elastic area in the direction of an edge of the elastically deformable skin while being bordered
(Continued)

by the peripheral elastic area, said elastic tertiary area having an elasticity lower than or equal to the elasticity of the central elastic area.

9 Claims, 7 Drawing Sheets

(58) Field of Classification Search
USPC ..... 206/521, 583, 591, 592, 594
See application file for complete search history.

(56) References Cited

U.S. PATENT DOCUMENTS 9,821,944 B1 11/2017 Russell
2006/0213803 A1* 9/2006 Saitou ..... B65D 81/05 206/583
2008/0128316 A1* 6/2008 McDonald ..... B65D 81/022 53/472
2011/0240515 A1* 10/2011 Ridgeway ..... B65D 5/5028 53/472
2014/0076769 A1* 3/2014 McDonald ..... B32B 7/023 206/583
2014/0183097 A1* 7/2014 LeRoy ..... B65D 81/05 206/583
2015/0239635 A1* 8/2015 McDonald ..... B65D 5/5028 206/583
2022/0002061 A1* 1/2022 Cotte ..... B65D 5/241

OTHER PUBLICATIONS

English translation of International Search Report as issued by the International Searching Authority, dated Dec. 21, 2021, for International Patent Application No. PCT/EP2021/078710; 2 pages.
English translation of the Written Opinion as issued by the International Searching Authority, dated Apr. 13, 2023, for International Patent Application No. PCT/EP2021/078710; 7 pages.

* cited by examiner

PACKAGING ITEM COMPRISING MEANS FOR RETAINING AN OBJECT

CROSS-REFERENCE TO RELATED APPLICATIONS

The present application is a national stage entry of International (PCT) Patent Application Number PCT/EP2021/078710, filed Oct. 15, 2021, which claims priority to French Patent Application Number 2010712, filed Oct. 19, 2020, the complete disclosures of which are expressly incorporated herein by reference.

The field of the invention is that of logistics.

More specifically, the invention relates to a package or a logistical packing means, that is to say a container, for the conveyance of objects between two destinations, by means of a package.

To transport an object in complete safety and reliably, packages such as boxes or cardboards are known.

In general, the packages comprise a crate with a bottom and a peripheral rim which together define an internal volume in which the object to be transported is housed.

The peripheral rim can be movable relative to the bottom of the crate. As such, it comprises several folding panels on the bottom or in the extension of the bottom of the crate.

The packages also comprise a lid movable relative to the crate. These lids can in particular adopt a closed position in which the lid seals the internal volume of the crate.

In order to allow the protection of the transported objects, some packages comprise retaining means to hold the object to be transported in the crate.

Retaining means which take the form of foam panels integrated into the crate and into the lid are known. The foam panels can, if necessary, be brought to the crate. In other words, the foam panels can be integrated into the crate only if their presence is required.

More specifically, the foam panels are secured to the bottom of the crate, possibly to its peripheral rim, and to the lid.

The object to be transported is then inserted into the internal volume so as to come into contact with the foam and to be blocked at least by the foam of the bottom and the foam of the lid.

This type of retaining means has as a major drawback its thickness or, in other words, the bulk it occupies in the internal volume of the crate.

Indeed, the foam takes up most of the internal volume of the crate. However, the foam has elastic characteristics so as to form deformable retaining means to fit the contour of the object to be transported.

However, depending on the size of the object, several packages must be provided.

For example, for a bulky object and for a small object, the same crate cannot be used. In the case of the small object, if a crate or a package suitable for a large object is used, the foam is not properly deformed when in contact with the small object, and the latter may then move in the internal volume of the crate at the risk of being damaged.

On the contrary, if a large object is introduced into the internal volume of a crate intended to contain a small object, the package may become unusable for lack of insufficient space in the internal volume, the lid therefore not being able to be properly closed so as to actually seal the internal volume of the crate. As a result, the object is not actually protected and is visible to anyone carrying the package, which can lead to a risk of theft of the object.

The carriers or the packaging professionals must therefore have packages of different sizes depending on the size of the objects to be transported.

According to another known technique, the retaining means are in the form of a plastic cover into which the object to be transported is slipped, the cover is then deformed so that its walls come into contact with the object to be transported and hold it in its position.

According to a first type, the covers can be secured to the bottom of the crate and their deformation can be achieved for example by heating so as to retract the material, generally a plastic material, so that it stiffens when in contact with the object.

A disadvantage of this solution lies in the fact that the deformation of the cover, when it is achieved by heating, cannot be achieved by everyone since this technique involves the use of specific heating equipment.

Indeed, heating means, such as thermal heaters for example, must be used and may require special training so that only the professionals can deform the cover.

Moreover, when the cover is secured to the bottom of the crate, this can have a major disadvantage for the integrity of the crate, in particular if it is made of cardboard, an excessive heat can destroy the cardboard by burning it.

In addition, the introduction of the object to be transported in the cover can prove to be difficult, even impossible.

This is particularly verified if the object to be transported is inserted into the cover once the crate is in shape, that is to say once the internal volume is defined, the peripheral rim of the crate forming a major obstacle to the insertion of the object into the cover.

To overcome this, it may be necessary, first, to insert the object into the cover, then to form the crate and finally to deform the cover.

This represents a significant handling time which can be detrimental for professionals and also impossible to achieve for private individuals, in particular to deform the cover or shape the crate.

According to a second type, the cover can also be secured to a plate intended to be housed in the crate. In this case, the object is introduced inside the cover then, in order to secure and hold the object, the cover is deformed by folding of the edges of the plate, so as to stretch the two walls of the cover to enclose the object. Once this is complete, the folded plate can be inserted into the crate and then the movable lid can be closed on the crate.

These retaining means also have certain drawbacks.

Indeed, the insertion of the object in the cover does not pose a problem, however the deformation of the plate, in particular the folding of its edges represents a complicated handling, even impossible to achieve when the object is bulky and when the cover to be deformed offers significant resistance to deformation. The deformation of the cover can then become time-consuming and discourage the professionals who will then make partial deformation or offer a larger package generating a higher transport cost for the end consumer.

In addition, this requires the storage of both the crate, the lid and the retaining means, which represents a detrimental total bulk and therefore an additional cost which is often passed on to the end client.

The addition of crumpled paper, air pockets, cardboard dividers, or foam beads is also known for wedging the object to be transported inside the package and protecting it during transport.

Another technique has been developed to meet the need for retaining an object in a package, while offering a simplified mode of operation compared to the known techniques.

This technique provides that the retaining means are secured to the lid and comprise an elastically deformable skin which comes into contact with the object contained in the package, to cover it and hold it against the bottom of the crate.

If such a solution is satisfactory, it nevertheless remains perfectible.

Indeed, the flexible skin has a tension applied to the object that could damage said object, in particular if it is particularly fragile.

Moreover, some objects may have complex shapes for which the elastically deformable skin cannot ensure their proper holding. Thus, it is possible that only part of the object is held by the elastically deformable skin while another part remains free to move in the package, at the risk of hitting the crate in case of violent displacement of the package.

Furthermore, when two objects of different sizes must be transported in the same package, it is necessary to keep them both in the package, which is only possible by means of a spacer or a wedge interposed between the two objects. This therefore makes it necessary to add weight to the package and especially to store any means that could form a spacer.

In addition, when the package has arrived at the recipient, the objects are removed and the package can be reused while the spacer is no longer useful and then thrown away. This then leads to a risk of pollution, in particular if the spacer is not thrown away in a recycling circuit or if its recycling is not possible.

The invention aims in particular to overcome the drawbacks of the prior art.

More specifically, the invention aims to propose a solution that allows the wedging of at least one object by automatically adapting to the characteristics of each object, in particular in terms of mechanical resistance and in terms of geometry.

The invention also aims to provide such a solution that allows creating, in the package, areas of different retaining strengths.

The invention also aims to provide such a solution that is simple to implement for a sender of the package.

The invention further aims to provide such a solution which has a small bulk when the package is stored between two uses.

These aims, as well as others which will appear subsequently, are achieved thanks to the invention which relates to a package comprising a crate with a bottom, the package further comprising retaining means for holding, in the crate, at least one object, the retaining means comprising an elastically deformable skin intended to cover the object(s) positioned on the bottom, characterized in that the elastically deformable skin has a central elastic area and a peripheral elastic area around the central elastic area, the central elastic area having a lower elasticity than the peripheral elastic area, and in that the elastically deformable skin also comprises at least one elastic tertiary area extending the central elastic area in the direction of an edge of the elastically deformable skin while being bordered by the peripheral elastic area, said elastic tertiary area having an elasticity lower than or equal to the elasticity of the central elastic area.

The presence of the tertiary area(s) allows limiting the spacing of the central elastic area relative to the bottom despite the deformation of the peripheral area.

The tertiary area(s) thus form(s) lines for pulling the central area towards the edges of the elastically deformable skin and therefore towards the bottom of the crate.

An object placed under the elastically deformable skin can therefore be held independently of its shape and/or its fragility. The differential elasticity of the net allows holding an object to be transported in the center of the package, this automatically with maximum protection.

According to a first advantageous embodiment, the central elastic area and each elastic tertiary area are made of a first material, the peripheral elastic area being made of a second material different from the first material, the first material having a lower elasticity than that of the second material.

The use of different materials allows accurately controlling the elasticity of each area.

According to another advantageous embodiment, the central elastic area and each elastic tertiary area have a plurality of first cutouts, the peripheral elastic area having a plurality of second cutouts, the density and the size of the first cutouts being lower than the density and the size of the second cutouts.

The presence of the first cutouts and of the second cutouts allows modifying and/or distributing the elasticity of the material(s) of the elastically deformable skin, in order to ensure the holding of an object in the crate.

Furthermore, the presence of cutouts allows modifying the elasticity of an area at least according to one particular use.

According to one advantageous embodiment, the elastically deformable skin has a rectangular shape, and comprises four elastic tertiary areas each extending towards one of the corners of the rectangular shape.

Such a configuration allows distributing the tension areas of the central elastic area so that the force exerted by the central elastic area on one object is uniform on the object.

According to another advantageous embodiment, the elastically deformable skin has a rectangular shape, and comprises eight elastic tertiary areas whose four elastic tertiary areas each extend towards one of the corners of the rectangular area and four other elastic tertiary areas each extend toward one of the sides of the rectangular shape.

Such a configuration allows further improving the distribution of the force exerted by the central elastic area on an object to be held in the crate.

According to yet another advantageous embodiment, the elastically deformable skin also comprises at least one subsidiary area among:

- a ring surrounding the central elastic area and the peripheral elastic area;
- a plurality of V-shapes each extending from the edge of the elastically deformable skin and pointing towards the central elastic area.

The presence of the ring and the V-shapes allows further controlling the deformation of the elastically deformable skin to improve the holding of an object in the crate.

Preferably, the crate comprises a rigid frame inside which the elastically deformable skin extends.

The rigid frame is used to allow spacing the elastically deformable skin of the crate in order to deposit an object therein or remove it therefrom. When an object is placed in the crate, the positioning of the rigid frame is then performed to allow the holding of the object in the crate.

In this case, the crate advantageously comprises a peripheral rim extending the bottom, the rigid frame being rotatably mounted on the peripheral rim.

The displacement of the elastically deformable skin relative to the bottom of the crate is then performed by a simple rotation of the rigid frame relative to the peripheral rim.

Advantageously, the package also comprises:

a lid rotatably mounted on the peripheral rim, a connecting rod rotatably mounted on the lid on the one hand, and rotatably mounted on the rigid frame on the other hand, the peripheral rim, the lid, the connecting rod and the rigid frame together forming a deformable parallelogram.

The presence of the connecting rod to form a deformable parallelogram with the peripheral rim, the rigid frame and the lid, allows facilitating the handling and the use of the lid since the simple positioning of the lid in a closed position, that is to say preventing access into the crate, allows positioning the rigid frame against the bottom of the crate and thus stretching the elastically deformable skin over the object to be held, so as to immobilize it in the crate.

Other characteristics and advantages of the invention will appear more clearly upon reading the following description of one preferred embodiment of the invention, given by way of illustrative and non-limiting example, and the appended drawings, among which:

FIG. 1 illustrates a package 1 according to the invention.

Figure 1:
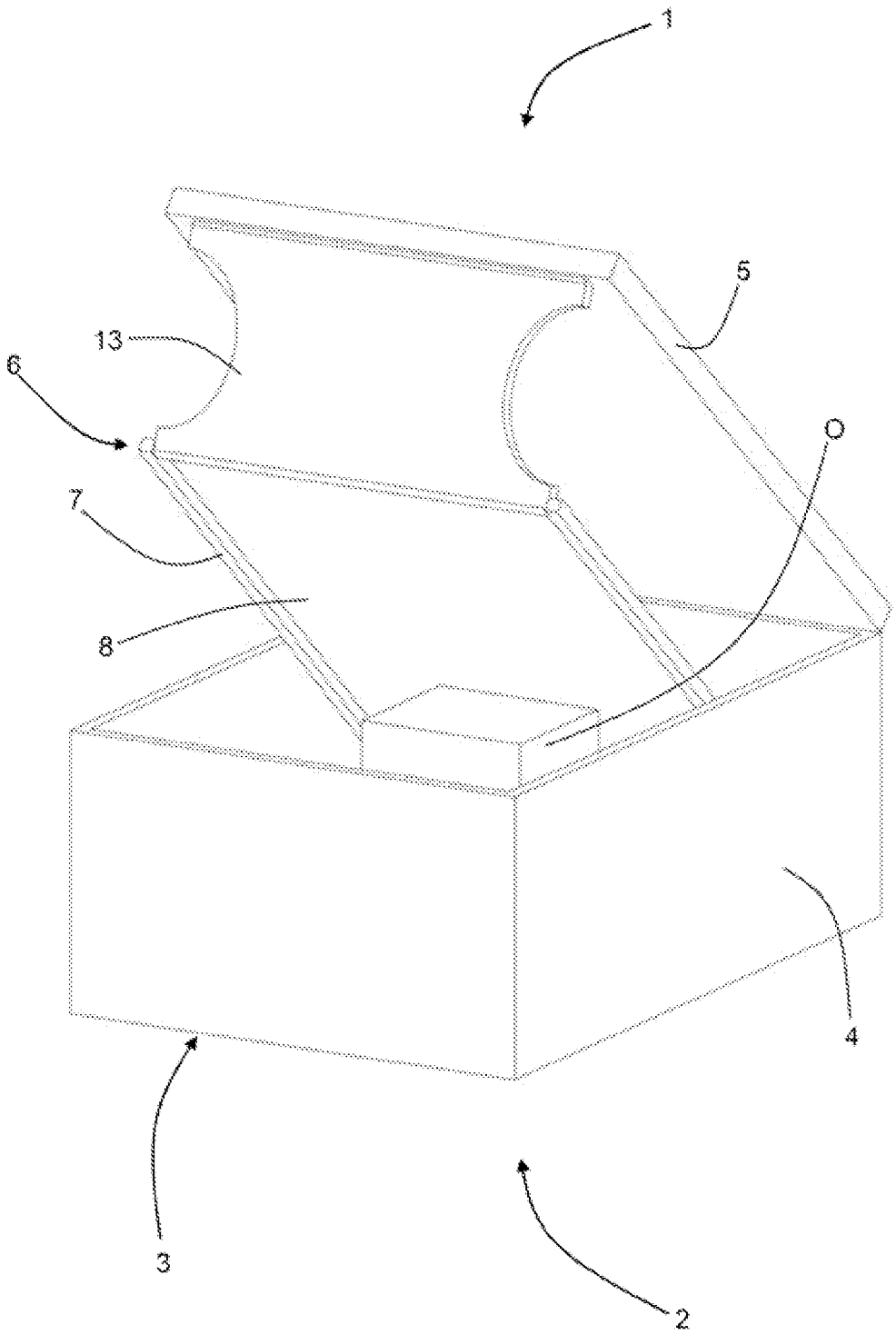
FIG. 1 is a perspective top view of a package according to the invention, comprising means for retaining an object in the package.

The package 1 comprises a crate 2.

The crate 2 comprises a bottom 3 and a peripheral rim 4, an upper face of which defines an opening of the crate 2.

The package 1 also comprises a lid 5 that allows closing the crate 2 and in particular authorizing or preventing access into the crate 2 by sealing the opening.

To ensure protection of an object O to be transported, the package 1 also comprises retaining means 6 mounted inside the crate 2.

Figure 2:
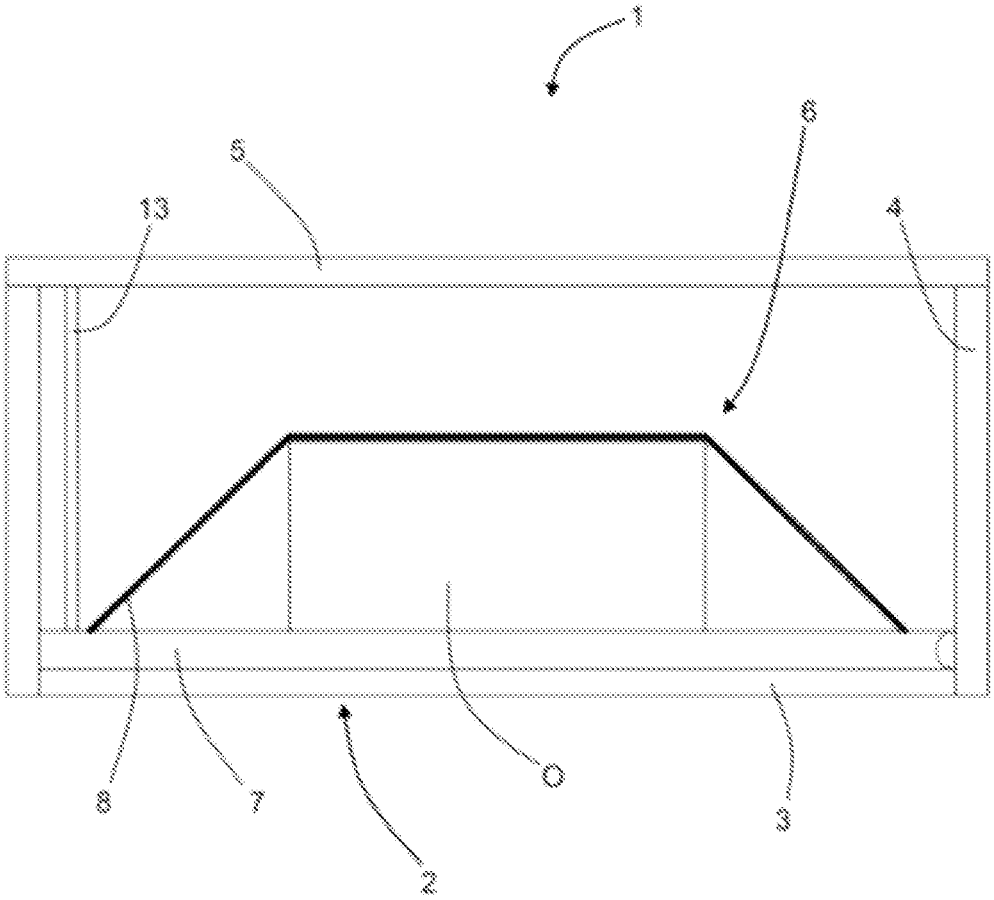
FIG. 2 is a longitudinal sectional view of the package of FIG. 1 showing an object held in the package by the retaining means.

As illustrated in FIGS. 1 and 2, the retaining means 6 comprise a rigid frame 7 and an elastically deformable skin 8.

The elastically deformable skin 8 is positioned inside the rigid frame 7 and kept substantially stretched therein.

As described below, and with reference to FIG. 2, when an object O is intended to be kept inside the package 1, the object O is positioned on the bottom 3 of the crate 2 and the frame 7 is positioned bearing against the bottom 3 of the crate 2. In this case, the elastically deformable skin 8 is deformed and at least partially fits the object O to keep it pressed against the bottom 3 of the crate 2.

The elastic characteristic of the elastically deformable skin 8 allows adapting to the different shapes that the object O can take.

However, the package 1 is intended to allow the transport of objects O of different sizes.

To do so, the elastically deformable skin 8 can be made according to different embodiments.

FIGS. 3, 4, 5, 6 and 7 illustrate different embodiments of the elastically deformable skin 8.

Commonly to all the embodiments, the elastically deformable skin 8 has a central elastic area 9 and a peripheral elastic area 10 around the central elastic area 9.

Preferably, the central elastic area 9 has a lower elasticity than the peripheral elastic area 10.

This allows, depending on the presence of an object O under the elastically deformable skin 8, providing the latter with a controlled deformation.

More specifically, the central elastic area 9 deforms less than the peripheral elastic area 10 in the presence of an object O to be held.

Thus, as explained below, depending on the size of the object O and its positioning relative to the elastically deformable skin 8, the object O can be held more or less loosely depending on the need.

Indeed, an object O placed only under the central elastic area 9 will be pressed against the bottom 3 of the crate 2 in a stronger way compared to its positioning under the peripheral elastic area 10.

Thus, it is possible, depending on the fragility of the object O, to choose the holding tension applied thereto depending on its positioning under the elastically deformable skin 8.

Figure 4:
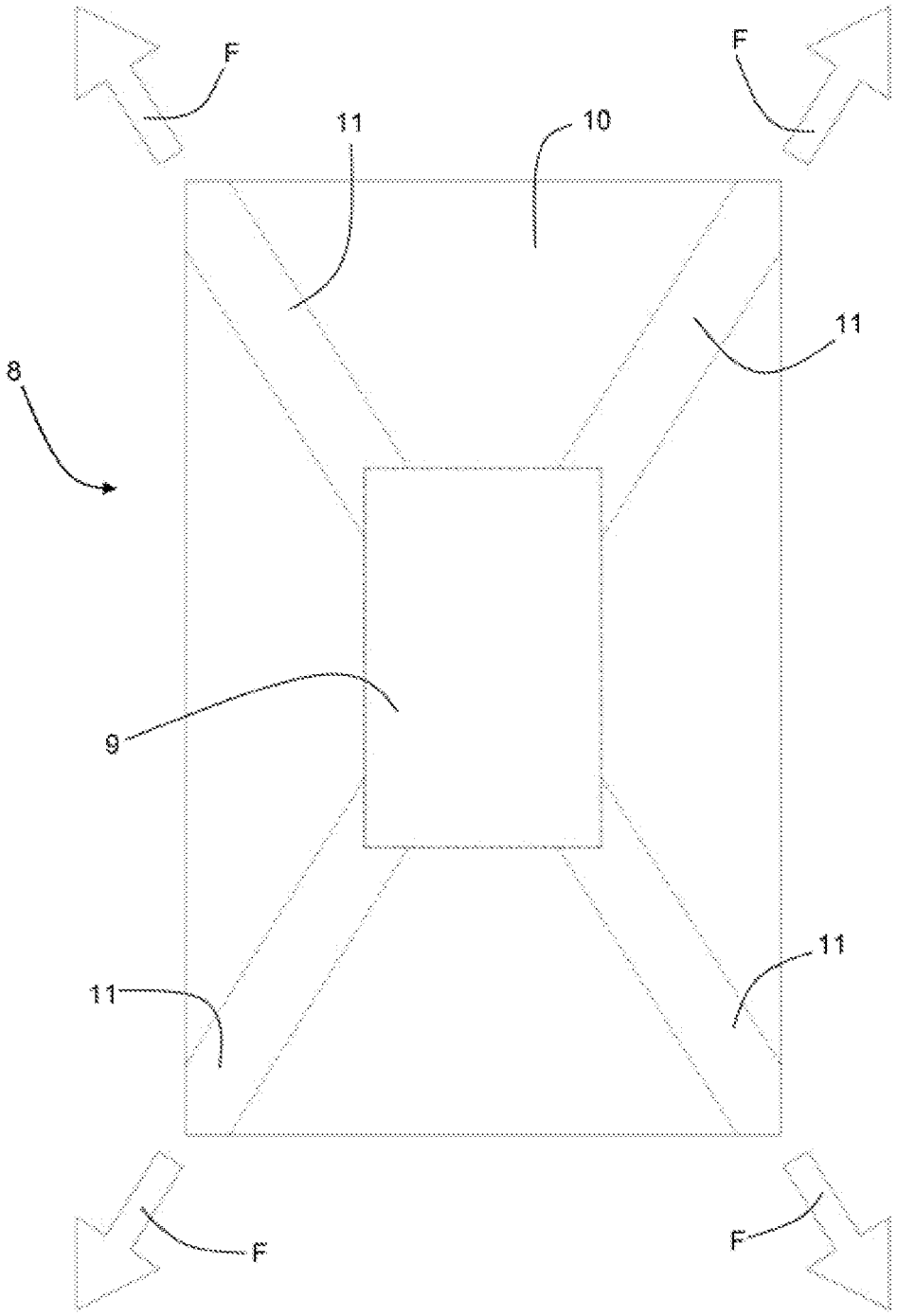
FIG. 4 is a schematic representation of a skin of the package retaining means according to the invention, according to a second embodiment.
Figure 5:
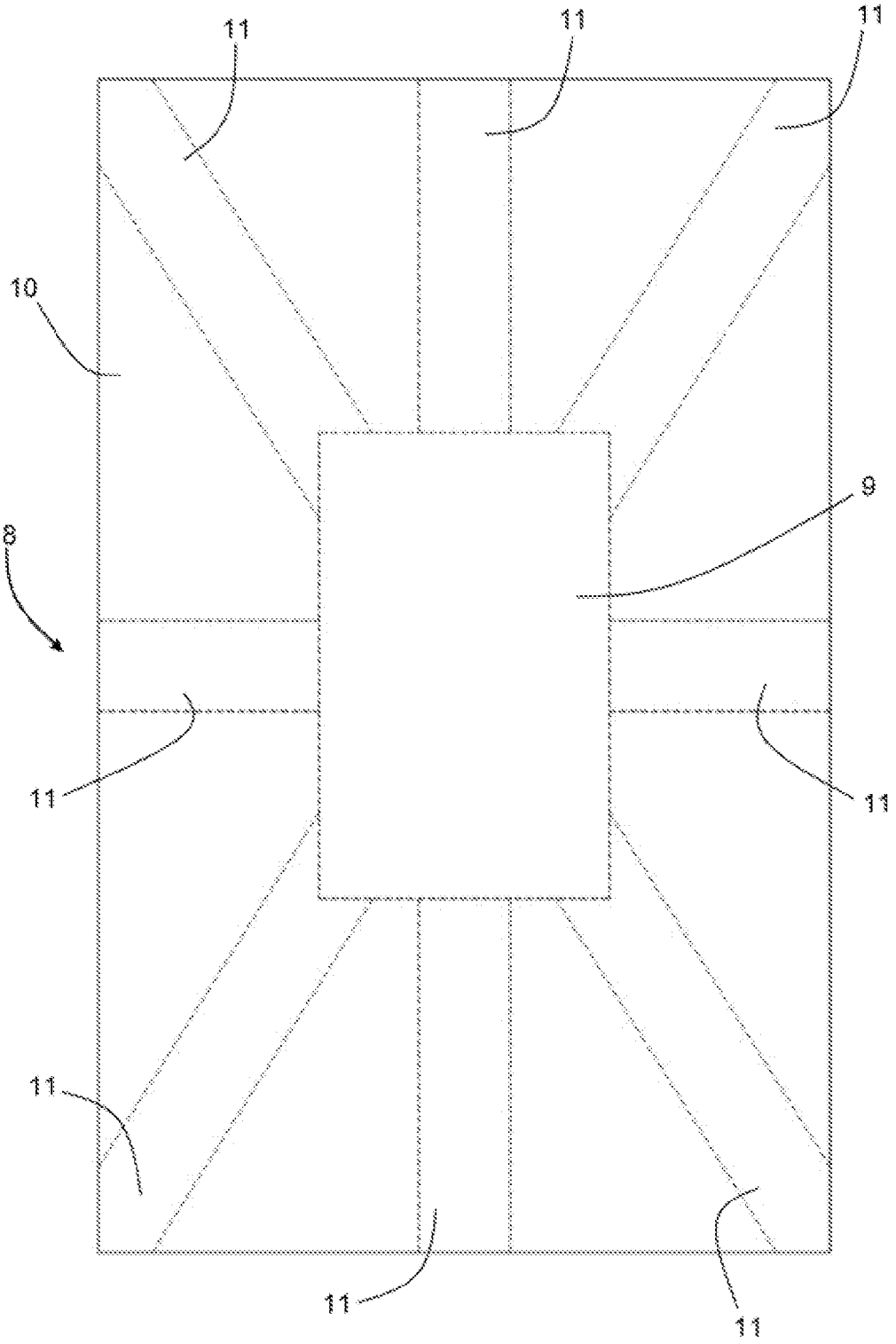
FIG. 5 is a schematic representation of a skin of the package retaining means according to the invention, according to a third embodiment.
Figure 7:
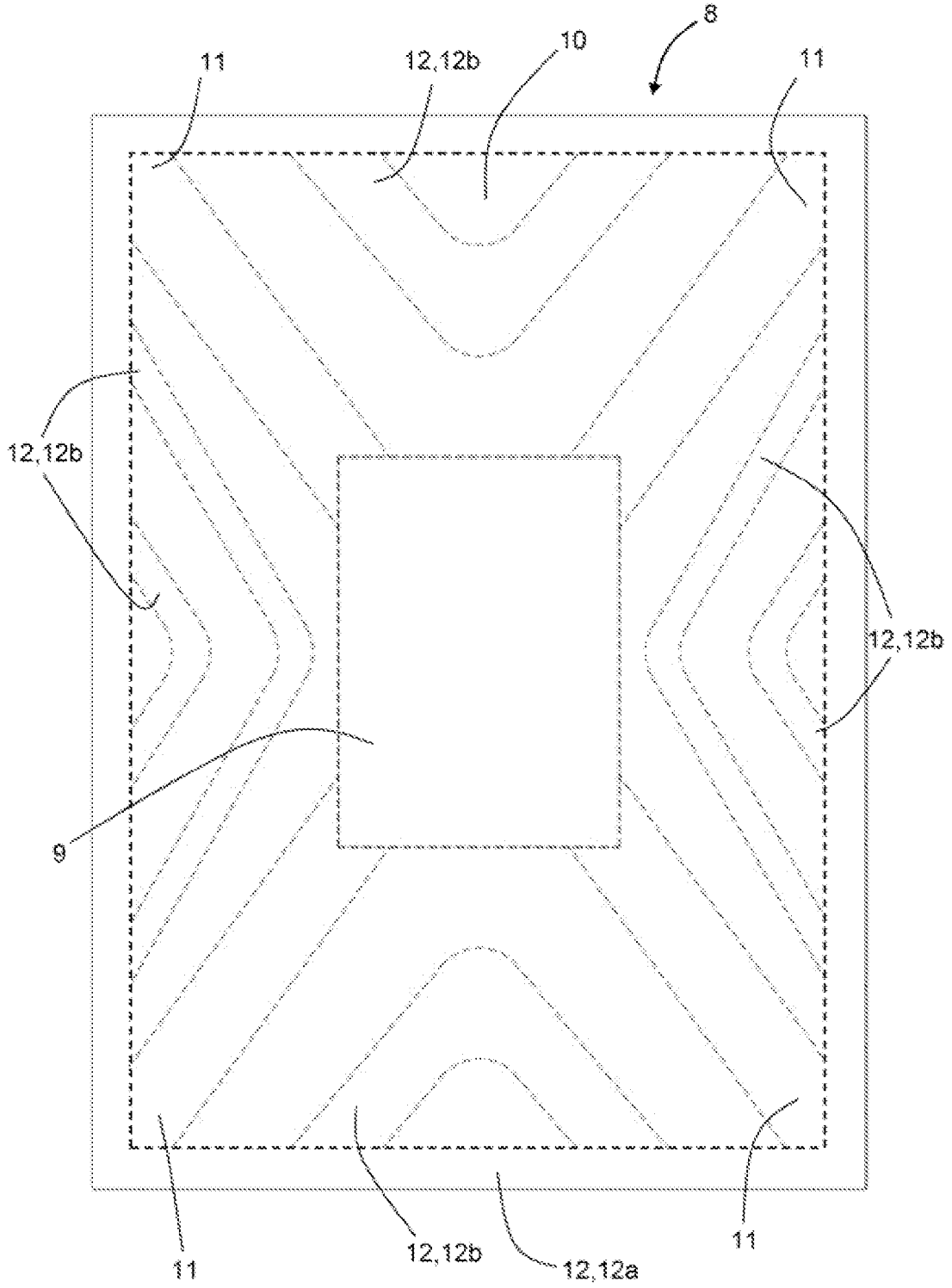
FIG. 7 is a schematic representation of a skin of the package retaining means according to the invention, according to a fifth embodiment.

Furthermore, as illustrated in FIGS. 4, 5 and 7, the elastically deformable skin 8 may have elastic tertiary areas 11 extending from the central elastic area 9 towards one of the edges of the elastically deformable skin 8.

The or each elastic tertiary area 11 extends the central elastic area 9 in the direction of an edge of the elastically deformable skin 8 while being bordered by the peripheral elastic area 10.

Like the central elastic area 9, the or each elastic tertiary area 11 has a lower elasticity than that of the peripheral elastic area 10.

More particularly, the or each elastic tertiary area 11 has an elasticity lower than or equal to the elasticity of the central elastic area 9.

This allows being able to generate pulling force lines for pulling the central elastic area 9 towards the bottom 3 of the crate 2.

To achieve this difference in elasticity between each of the areas, a first technique consists in forming the skin by assembling several pieces of different materials.

By way of example, the central elastic area 9 and each elastic tertiary area 11 are made of a first material and the peripheral elastic area 10 is made of a second material different from the first material. The first material then has an elasticity lower than that of the second material.

The assembly between the different materials can be made optionally by one of the following methods:

sewing;

gluing;

welding;

fusion.

As a variant, when each elastic tertiary area 11 has a lower elasticity than the central elastic area 9, these can be made of a third material which then has an elasticity lower than the elasticity of the first material.

According to another technique, the elastically deformable skin 8 is made in one piece and each area is made by cutting out said elastically deformable skin 8.

Figure 3:
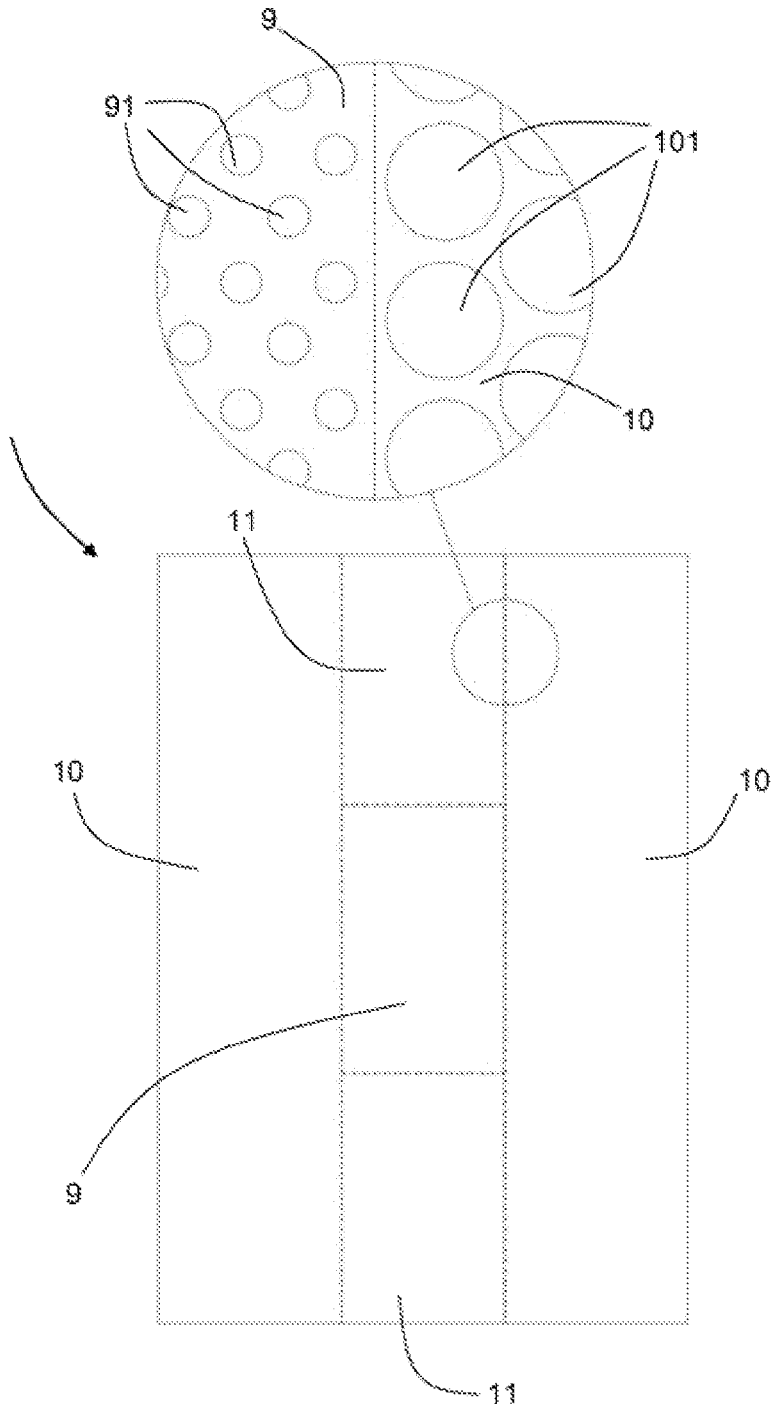
FIG. 3 is a schematic representation of a skin of the package retaining means according to the invention, according to a first embodiment.

More specifically, with reference to the detail medallion of FIG. 3, the central elastic area 9 has a plurality of first cutouts 91 and the peripheral elastic area 10 has a plurality of second cutouts 101.

The density and the size of the first cutouts 91 is lower than the density and the size of the second cutouts 101.

In other words, the greater the size and the density of the cutouts, the more the skin is devoid of material, and therefore has a high elasticity.

In the case where the elastic tertiary areas 11 have an elasticity equal to the elasticity of the central elastic area 9, each elastic tertiary area 11 then has a plurality of first cutouts 91.

On the other hand, in the case where the elastic tertiary areas 11 have a lower elasticity than that of the central elastic area 9, then each elastic tertiary area 11 has third cutouts (not illustrated) whose density and size is lower than that of the first cutouts 91.

Preferably, the cutouts have a circular or ovoid shape, so as to avoid any angle that could generate an incipient rupture. Indeed, when an elastically deformable material hardens, in particular by the effect of time, heat or by the effect of its wear, it tends to crack, and when the cracks appear in angular areas, they promote the tearing of the elastic material.

According to a first embodiment illustrated in FIG. 3, the elastically deformable skin 8 has a rectangular shape, and has an elastic shape 9 extended on either side in the direction of the smaller sides of the rectangular shape by two elastic tertiary areas 11 each joining an edge of the elastically deformable skin 8, in opposite directions relative to each other.

According to a second embodiment illustrated in FIG. 4, the elastically deformable skin 8 is rectangular in shape and has four elastic tertiary areas 11 each extending from the central elastic area 9 in the direction of a corner of the rectangular shape of the elastically deformable skin 8.

According to a third embodiment illustrated in FIG. 5, the characteristics of the elastically deformable skin 8, according to the second embodiment illustrated in FIG. 4, are reproduced and improved.

To do so, the elastically deformable skin 8 comprises four elastic tertiary areas 11 each extending from the central elastic area 9 in the direction of a corner of the rectangular shape of the elastically deformable skin 8, as well as four elastic tertiary areas 11 each extending from the central elastic area 9 in the direction of one side of the rectangular shape of the elastically deformable skin 8.

This thus allows offering tension lines of the central elastic area 9 in the direction of the bottom 3 of the crate 2, in a substantially homogeneous manner.

To avoid excessively angular tension areas, the junctions between the elastic tertiary areas 11 and the central elastic area 9 are made by roundings.

Furthermore, to exert a force for pressing an object O against the bottom 3 of the crate 2 by the elastically deformable skin 8, the latter may comprise an overlap area C between the central elastic area 9, the area or each elastic tertiary area 11 and the peripheral elastic area 10.

Figure 6:
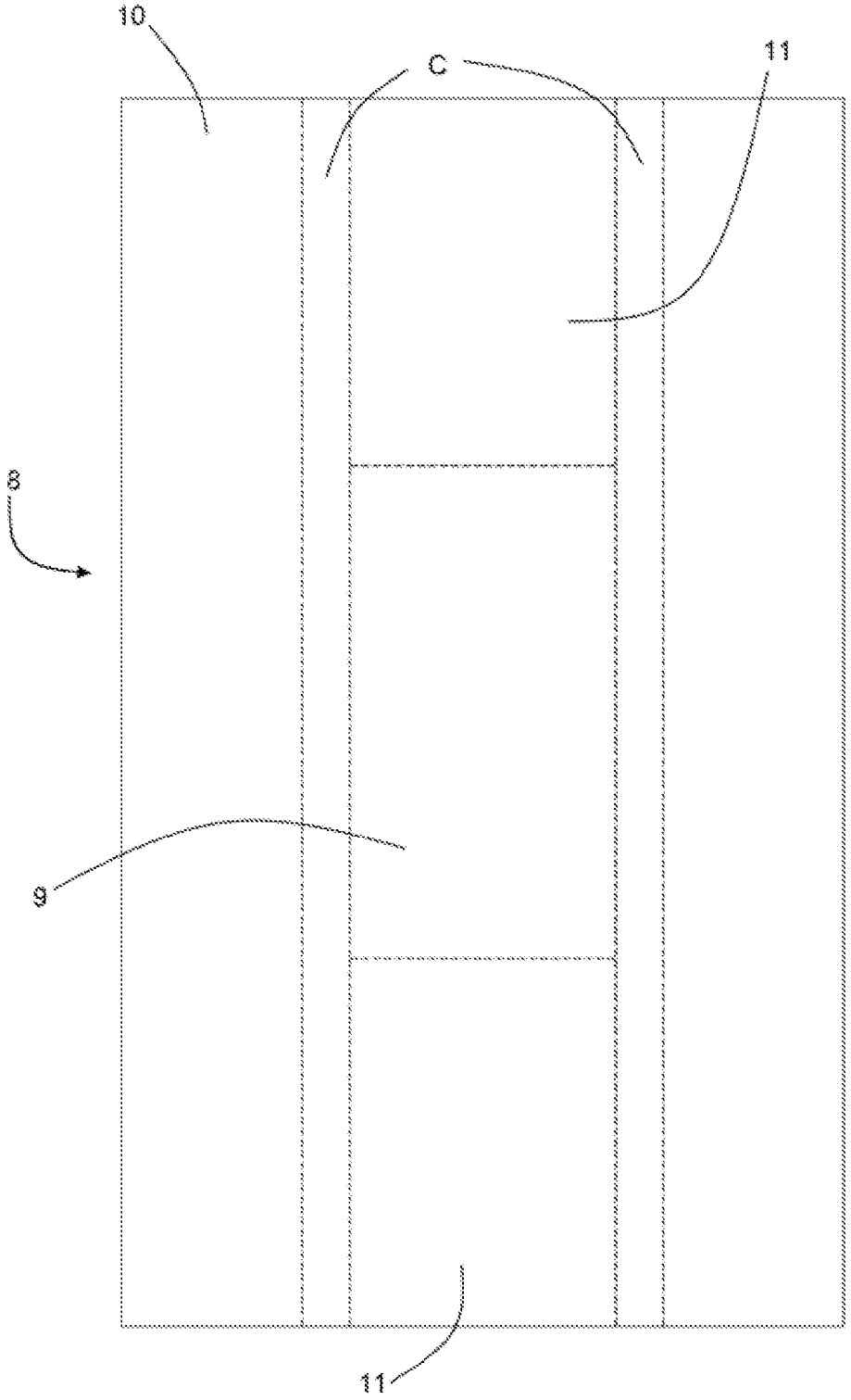
FIG. 6 is a schematic representation of a skin of the package retaining means according to the invention, according to a fourth embodiment.

This is in particular illustrated in the fourth embodiment illustrated in FIG. 6. The overlap area C allows creating an area of elasticity greater than the elasticity of the peripheral elastic area 10, but lower than the elasticity of the central elastic area 9 and/or of the area or of each elastic tertiary area 11.

According to a fifth embodiment illustrated in FIG. 7, the elastically deformable skin 8 also comprises at least one subsidiary area 12 among:

- a ring 12*a* surrounding the central elastic area 9 and the peripheral elastic area 10;
- a plurality of V-shapes 12*b* each extending from the edge of the elastically deformable skin 8 and pointing towards the central elastic area 9.

As illustrated in FIG. 7, the elastically deformable skin comprises both a subsidiary area 12 in the shape of a ring 12*a* and six V-shapes 12*b*.

When using the package 1, as illustrated by the arrows F in FIG. 4, the elastic tertiary areas 11 allow, through their low elasticity, limiting the deformation of the central elastic area 9, that is to say its spacing relative to the bottom 3 of the crate 2, which allows keeping an object O immobile in the crate 2 when said object O is positioned between the bottom 3 of the crate 2 and the elastically deformable skin 8.

The same applies for the subsidiary areas 12 that have an elasticity at least lower than the elasticity of the peripheral elastic area 10 and, preferably, lower than or equal to the elasticity of the central elastic area 9.

Referring to FIG. 1, the package 1 also comprises a connecting rod 13 interposed between the lid 5 and the rigid frame 7 of the retaining means 6.

Preferably, the connecting rod 13 is rotatably mounted on the lid on the one hand, and rotatably mounted on the rigid frame 7 on the other hand.

According to one particular embodiment, the connecting rod 13 forms part of the rigid frame 7.

The peripheral rim 4, the lid 5, the connecting rod 13 and the rigid frame 7 together form a deformable parallelogram.

More specifically, the lid 5, which is rotatably mounted on the peripheral rim 4, can adopt an open position in which it is substantially perpendicular to the bottom 3 of the crate 2 and does not prevent access into the crate 2, and a closed position in which it prevents access into the crate 2, and is substantially parallel to the bottom 3 of the crate 2.

As illustrated in FIG. 1, the lid 5 is in an intermediate position between its open position and its closed position.

The rotation of the connecting rod 13 relative to the lid 5 and to the rigid frame 7 allows deforming the parallelogram and in particular pivoting the rigid frame 7 when the lid 5 passes from its closed position to its open position, and vice versa.

In use, a user positions the lid 5 in its open position, the rigid frame 7 then being spaced from the bottom 3 of the crate 2. Then, the user inserts an object O into the crate and positions it on the bottom 3 of the crate 2.

The user then handles the lid 5 to place it in its closed position.

During this handling, the connecting rod 13 then drives in rotation the rigid frame 7 in the direction of the bottom 3 of the crate 2.

When the lid 5 is in its closed position, as illustrated in FIG. 2, the rigid frame 7 is substantially parallel to the bottom 3 of the crate 2, in the vicinity of the bottom 3 and the elastically deformable skin 8 deforms when in contact with the object O located on the bottom 3 of the crate 2.

The presence of the elastic tertiary areas 11 allows limiting the deformation of the elastically deformable skin 8 and in particular the deformation of the central elastic area 9, that is to say its distance from the bottom 3 of the crate 2, which allows ensuring proper holding of the object O on the bottom 3 of the crate 2 of the package 1 for transportation.

The invention claimed is:

1. A package comprising a crate with a bottom, the package further comprising retaining means for holding, in the crate, at least one object, the retaining means comprising an elastically deformable skin intended to cover the object(s) positioned on the bottom, wherein the elastically deformable skin has a central elastic area and a peripheral elastic area around the central elastic area, the central elastic area having a lower elasticity than the peripheral elastic area, and in that the elastically deformable skin also comprises at least one elastic tertiary area extending the central elastic area in the direction of an edge of the elastically deformable skin while being bordered by the peripheral elastic area, said elastic tertiary area having an elasticity lower than or equal to the elasticity of the central elastic area.

2. The package according to claim 1, wherein the central elastic area and each elastic tertiary area are made of a first material, the peripheral elastic area being made of a second material different from the first material, the first material having a lower elasticity than that of the second material.

3. The package according to claim 1, wherein the central elastic area and each elastic tertiary area have a plurality of first cutouts, the peripheral elastic area having a plurality of second cutouts, the density and the size of the first cutouts being lower than the density and the size of the second cutouts.

4. The package according to claim 1, wherein the elastically deformable skin has a rectangular shape, and comprises four elastic tertiary areas each extending towards one of the corners of the rectangular shape.

5. The package according to claim 1, wherein the elastically deformable skin has a rectangular shape, and comprises eight elastic tertiary areas whose four elastic tertiary areas each extend towards one of the corners of the rectangular area and four other elastic tertiary areas each extend towards one of the sides of the rectangular shape.

6. The package according to claim 1, wherein the elastically deformable skin also comprises at least one subsidiary area among:

a ring surrounding the central elastic area and the peripheral elastic area;

a plurality of V-shapes each extending from the edge of the elastically deformable skin and pointing towards the central elastic area.

7. The package according to claim 1, wherein the crate comprises a rigid frame inside which the elastically deformable skin extends.

8. The package according to claim 7, wherein the crate comprises a peripheral rim extending the bottom, the rigid frame being rotatably mounted on the peripheral rim.

9. The package according to claim 8, wherein it also comprises:

a lid rotatably mounted on the peripheral rim, a connecting rod rotatably mounted on the lid on the one hand, and rotatably mounted on the rigid frame on the other hand, the peripheral rim, the lid, the connecting rod and the rigid frame together forming a deformable parallelogram.

* * * * *